United States Patent [19]

Keeffe et al.

[11] 4,278,910

[45] Jul. 14, 1981

[54] HIGH PRESSURE ARC DISCHARGE LAMP HAVING CONCAVE SHAPED OUTER JACKET

[75] Inventors: William M. Keeffe, Rockport; David R. Brown, Beverly, both of Mass.

[73] Assignee: GTE Products Corporation, Stamford, Conn.

[21] Appl. No.: 64,157

[22] Filed: Aug. 6, 1979

[51] Int. Cl.[3] ..... H01J 17/16; H01J 61/34

[52] U.S. Cl. ..... 313/220; 313/17; 313/25

[58] Field of Search ..... 313/220, 25, 26, 17

[56] References Cited

U.S. PATENT DOCUMENTS

| | | | |
|---|---|---|---|
| 1,930,090 | 10/1933 | Gaidies | 313/220 X |
| 1,930,132 | 10/1933 | Reger | 313/220 X |
| 2,056,642 | 10/1936 | Zecher | 313/220 X |
| 2,248,425 | 7/1941 | Dorsey | 313/220 X |
| 2,266,174 | 12/1941 | De Graaf | 313/17 X |
| 2,721,285 | 10/1955 | Beese | 313/25 |
| 3,085,171 | 4/1963 | Smialek | 313/25 |
| 3,761,758 | 9/1973 | Bamberg et al. | 313/229 |

FOREIGN PATENT DOCUMENTS

| | | | |
|---|---|---|---|
| 759125 | 10/1956 | United Kingdom | 313/17 |

*Primary Examiner*—Robert Segal

*Attorney, Agent, or Firm*—James Theodosopoulos

[57] ABSTRACT

A high pressure arc discharge lamp comprises an elongated arc tube disposed substantially axially within a concave shaped outer jacket.

1 Claim, 1 Drawing Figure

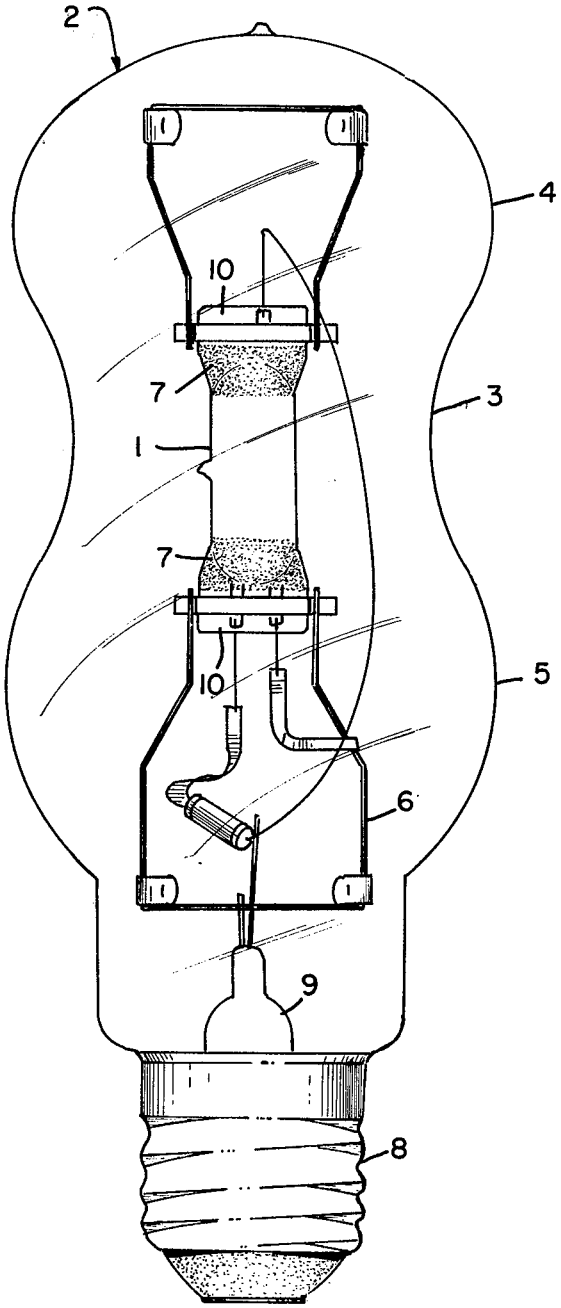
2
4
10
7
3
1
7
10
5
6
9
8

HIGH PRESSURE ARC DISCHARGE LAMP HAVING CONCAVE SHAPED OUTER JACKET

DESCRIPTION

1. Technical Field

This invention is concerned with high pressure arc discharge lamps comprising an arc tube disposed substantially axially within an outer jacket. Such lamps are shown in U.S. Pat. No. 3,761,758.

Some common types of high intensity discharge lamps used for lighting comprise a quartz or fused silica arc tube enclosed within a glass outer jacket fitted with a screw base at one end. In high pressure mercury vapor lamps, the arc tube contains a filling of mercury, whereas in high pressure metal halide lamps the arc tube contains a filling of mercury and metal halides. In both types, the mercury fill is completely vaporized and the inner arc tube operates at saturated vapor pressures greater than atmospheric.

In most lamps the inner arc tube remains intact to the end, and life is terminated by other factors. However, it does happen occasionally that the arc tube fails violently, in which case, hot quartz arc tube fragments may shatter the outer jacket and shower upon nearby objects.

2. Disclosure of Invention

It is the purpose of this invention to provide an outer jacket that will contain all arc tube fragments when the arc tube fails violently. This is accomplished by making the portion of the outer jacket that surrounds the arc tube concave shaped. In the prior art, the portion of the outer jacket that surrounds the arc tube is either cylindrical or it is spherical or bulbous, that is to say, convex shaped.

BRIEF DESCRIPTION OF THE DRAWING

The drawing is an elevational view of a high pressure arc discharge lamp in accordance with this invention.

BEST MODE FOR CARRYING OUT THE INVENTION

In the embodiment shown in the drawing, the lamp comprises a quartz arc tube 1 disposed within an outer jacket 2 having a constricted waist. Constricted waist means that the portion 3 of jacket 2 surrounding arc tube 1 is concave shaped and is of smaller diameter than the adjacent portions 4 and 5 of jacket 2. The arc tube assembly is of usual construction such as is shown in U.S. Pat. No. 3,761,758. It includes a frame 6 to support arc tube 1 and to conduct electrical current from the usual metal base 8 to the electrodes at each end of arc tube 1. The electrodes are hidden by reflective coating 7. Frame 6 is supported in the usual glass stem press mount 9.

A comparison was made on 175 watt metal halide lamps. The prior art lamps had the usual BT 28 outer jacket; BT means bulbous tubular, and 28 is the maximum diameter of the jacket in eighth's of an inch, or $3\frac{1}{2}$ inches. In the lamps as per this invention each outer jacket 2 had a constricted waist diameter 3 of about $2\frac{1}{2}$ inches, the maximum diameter at portions 4 and 5 of jacket 2 being about three inches. In both types of lamps, the outer jacket was made of 1.7 mm thick lead-doped hard glass, Corning No. 7720, which is the type of glass generally used for the outer jackets of high intensity discharge lamps, whether mercury, metal halide or high pressure sodium.

The comparison was made by operating the lamps to attain normal equilibrium operating conditions and then causing the hot arc tubes to explode. This was done by discharging a capacitor charged to about 0.1 coulombs through each arc tube. In only 50% of the prior art lamps did the outer jacket contain all arc tube fragments. However, in all the lamps as per this invention, the outer jacket contained all arc tube fragments. Since, upon explosion, the fragments are propelled substantially normal to the arc tube axis, the lenghth of concave portion 3 should be at least about the internal length of arc tube 1 (excluding pressed seal ends 10 thereof). However, since the chamber ends of arc tube 1 are rounded, the length of concave portion 3 should preferably be somewhat longer than said internal length of arc tube 1. In the 175 watt embodiment shown in the drawing, said internal length of arc tube 1 was about $1\frac{3}{8}$ inches and said length of concave portion 3 was about $2\frac{1}{2}$ to 3 inches.

Life tests on the 175 watt lamps showed that constricted waist lamps as per this invention had better maintenance than the prior art BT lamps. At 2000 hours life, the respective maintenance results were 87.5% and 74.2%. At 6000 hours life, the respective maintenance results were 72% and 54%.

In the embodiment shown in the drawing, the concave shape of jacket 2 was formed from the same molded glass envelope used to prepare a BT 28 jacket. The envelope comprised a closed dome region at one end, a bulbous region next thereto, a smaller diameter stem-sealing zone next thereto, and an open-ended flare region. The concave shape was formed by heating the envelope, while rotating on a glass lathe, to its working temperature and pressing a three inch radiused carbon paddle against the softened bulbous region while pneumatic pressure was applied within the envelope, and then cooling the envelope after it had become concave shaped. The arc tube assembly was sealed in the envelope in the usual manner, namely, by fusing the flare of stem press 9 to the stem-sealing zone of the envelope. Constricted waist jackets formed this way were examined by photoelastic stress analysis in an oil bath polariscope to determine the maximum tension or compression stress on the walls of the jacket. The outer surface of constricted waist 3 was found to be under compressive stress, while the inner surface thereof was found to be under tensile stress.

If desired, the inner surface of constricted waist jacket 2 could be phosphor coated, as is presently done on the jackets of some types of high intensity discharge lamps.

We claim:

1. In a high pressure arc discharge lamp of the type comprising an elongated arc tube having electrodes at its ends and disposed substantially axially within a glass outer jacket, the improvement which comprises the portion of the outer jacket surrounding the arc tube having a concave shape longer than the internal length of the arc tube, the pressure in the arc tube during normal operation being greater than one atmosphere.

* * * * *